US005745938A

United States Patent [19]

Bartley et al.

[11] Patent Number: 5,745,938

[45] Date of Patent: May 5, 1998

[54] RESCUE BOARD

[75] Inventors: Charles Allen Bartley; Robert Burks Scruggs, II, both of Covington, Va.

[73] Assignee: Westvaco Corporation, New York, N.Y.

[21] Appl. No.: 704,919

[22] Filed: Aug. 30, 1996

[51] Int. Cl.[6] ..... A61G 1/013

[52] U.S. Cl. ..... 5/625; 5/627; 128/870

[58] Field of Search ..... 5/625, 627, 628; 128/846, 869, 870

[56] References Cited

U.S. PATENT DOCUMENTS

| | | | |
|---|---|---|---|
| 681,559 | 8/1901 | Lohsen . | |
| 1,072,052 | 9/1913 | Stoehr | 5/627 |
| 2,141,100 | 12/1938 | Warden . | |
| 2,142,215 | 1/1939 | Schmidt | 5/625 |
| 2,675,564 | 4/1954 | Hughes . | |
| 3,648,305 | 3/1972 | Ersek | 5/625 |
| 3,797,051 | 3/1974 | Evans | 5/627 |
| 3,890,659 | 6/1975 | Staubs | 5/625 |
| 4,259,950 | 4/1981 | Klippel . | |
| 4,369,982 | 1/1983 | Hein et al. . | |
| 4,506,664 | 3/1985 | Brault . | |
| 4,655,206 | 4/1987 | Moody . | |
| 4,895,173 | 1/1990 | Brault et al. . | |
| 5,048,134 | 9/1991 | Dennill et al. . | |
| 5,148,815 | 9/1992 | Britton . | |
| 5,154,186 | 10/1992 | Laurin et al. . | |
| 5,190,056 | 3/1993 | Hull . | |
| 5,285,797 | 2/1994 | Zeller . | |
| 5,317,770 | 6/1994 | Sakurai . | |
| 5,414,883 | 5/1995 | Fangrow, Jr. . | |
| 5,435,323 | 7/1995 | Rudy . | |
| 5,437,784 | 8/1995 | Meinecke et al. . | |
| 5,515,869 | 5/1996 | Powell et al. . | |

OTHER PUBLICATIONS

Jackie Cox, "Don't Get Caught Up In Confined Spaces," Oct. 1996, *Papermaker*, pp. 33–35.

*Primary Examiner*—Steven N. Meyers
*Assistant Examiner*—Robert G. Santos
*Attorney, Agent, or Firm*—J. R. McDaniel; R. L. Schmalz

[57] ABSTRACT

This invention relates to rescue boards that are constructed of several individual pieces. Such structures of this type, generally, allow the rescue personnel to extricate an unconscious or injured person from a confined space through a small opening and onto a backboard for transport to a medical facility.

7 Claims, 4 Drawing Sheets

RESCUE BOARD

BACKGROUND OF THE INVENTION

1. Field of the Invention:

This invention relates to rescue boards that are constructed of several individual pieces. Such structures of this type, generally, allow the rescue personnel to extricate an unconscious or injured person from a confined space through a small opening and onto a backboard for transport to a medical facility.

2. Description of the Related Art:

It has come to the attention of the present inventors that when attempting to rescue an unconscious or injured person from a confined space having a small opening, standard equipment will not go through the small hole. Consequently, this requires that the unconscious person be raised to the level of the small hole. This, typically, requires at least four individuals to raise the person and work the individual through the hole. However, due to the opening size, the number of people that could enter the confined space through the small hole is limited. Also, Occupational Safety and Health Administration (OSHA) regulations prohibit persons from entering a confined space for a rescue to only trained rescue personnel.

It is also known, in body restraint devices of the board-type, to employ different techniques and apparatus for the purpose of securing a patient to the board for transportation to a medical facility. Exemplary of such prior art are U.S. Pat. No. 2,675,564 ('564) to R. C. Hughes, entitled "Stretcher", U.S. Pat. No. 4,259,950 ('950) to A. P. Klippel, entitled "Extrication Backbrace", and U.S. Pat. No. 4,506,664 ('664) to R. A. Brault, entitled "Spineboard". While these devices are made for the purpose of securing a patient to the board for transportation to a medical facility, these devices would not be able to be used to extricate an unconscious or injured person from a confined space through a small opening and onto a backboard for subsequent transport to the medical facility. Therefore, a more advantageous device, then, would be presented if the device could be used in a confined space having a small opening.

It is apparent from the above that there exists a need in the art for a rescue board which is light weight through simplicity of parts and uniqueness of structure, and which at least equals the securing techniques of the known rescue devices, but which at the same time is capable of being used to extricate an unconscious or injured person from a confined space having a small opening. It is the purpose of this invention to fulfill this and other needs in the art in a manner more apparent to the skilled artisan once given the following disclosure.

SUMMARY OF THE INVENTION

Generally speaking, this invention fulfills these needs by providing a rescue board for extricating an unconscious or injured patient from a confined space through a small opening, comprising: a rigid lower assembly means for assisting in lifting and retaining the patient; and a rigid upper assembly holding means hingedly attached to the lower assembly means and capable of being secured to an area substantially adjacent to the small opening.

In certain preferred embodiments, the patient retaining means includes a patient guiding means. Also, the holding means includes a patient guiding means. Finally, the securing means includes a U-shaped connection for securing the rescue board.

In another further preferred embodiment, the rescue board of the present invention allows for the extrication of an unconscious or injured person from a confined space through a small opening and onto a backboard for subsequent transport to a medical facility.

The preferred rescue board, according to this invention, offers the following advantages: lightness in weight; ease of assembly; good stability; good durability; good economy; high strength for safety; and excellent extrication characteristics. In fact, in many of the preferred embodiments, these factors of lightness in weight, ease of assembly, stability, strength and extrication are optimized to the extent that is considerably higher than heretofore achieved in prior, known body restraint devices.

The above and other features of the present invention, which will become more apparent as the description proceeds, are best understood by considering the following detailed description in conjunction with the accompanying drawings, wherein like characters represent like parts throughout the several views and in which:

A BRIEF DESCRIPTION OF THE DRAWINGS

DETAILED DESCRIPTION OF THE INVENTION

Figure 1:
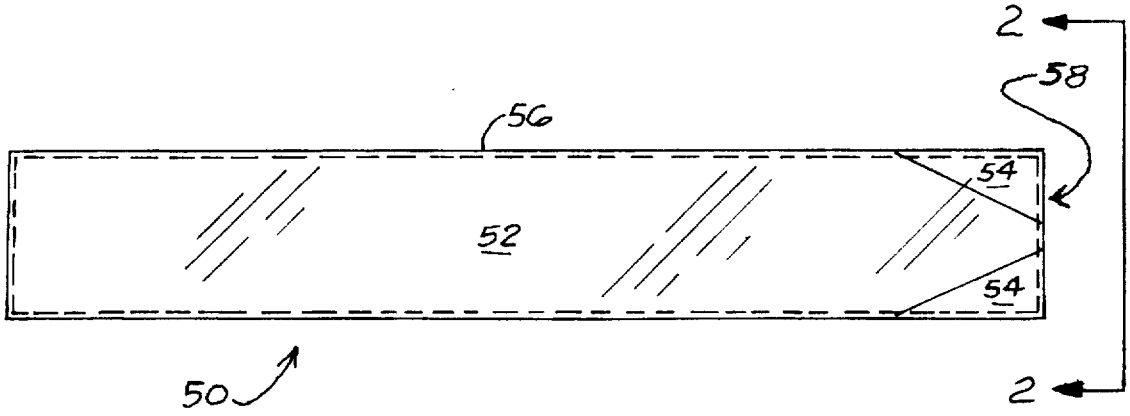
FIG. 1 is a top plan view of a lower portion of a rescue board, according to the present invention.
Figure 5:
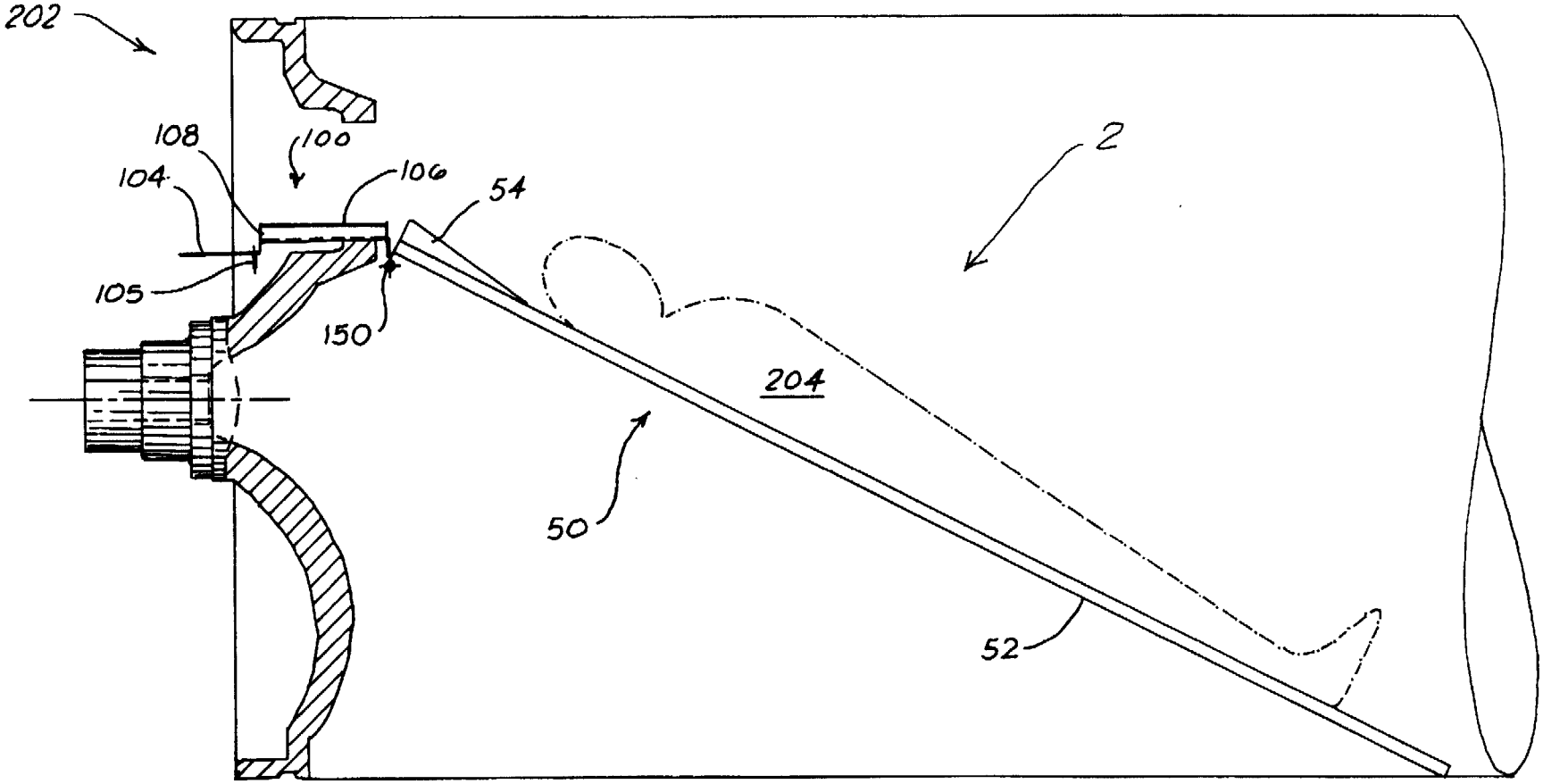
FIG. 5 is a schematic illustration of the rescue board, according to the present invention, being located within a confined space and the unconscious or injured person being placed upon the rescue board.
Figure 6:
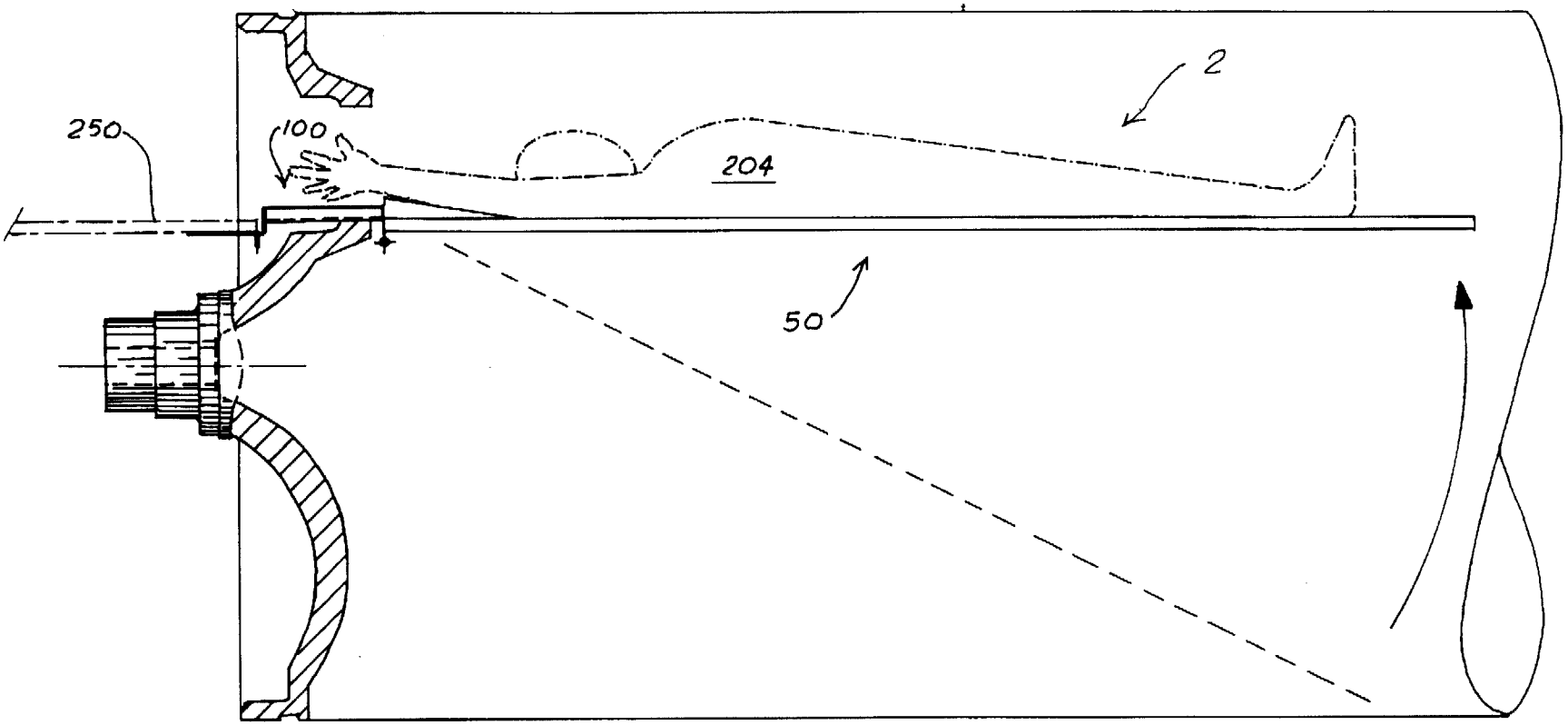
FIG. 6 is a schematic illustration of the unconscious or injured person being elevated within the confined space such that the person can be extricated from the confined space.

With reference first to FIG. 1, there is illustrated a lower rescue board assembly 50. It is to be understood that lower assembly 50 and upper assembly 100 (FIGS. 3 and 4) are part of rescue board 2 (FIGS. 5 and 6). However, in order to avoid further confusion, lower assembly 50 will now be discussed.

Lower assembly 50 includes, in part, plate 52, patient supports 54, structural rails 56, and hinge plate 58. Preferably, elements 52, 54, 56 and 58 are constructed of any suitable metallic material, such as, aluminum. It is also to be understood that plate 52, preferably, should be long enough to support at least the average build of a human being.

Figure 2:
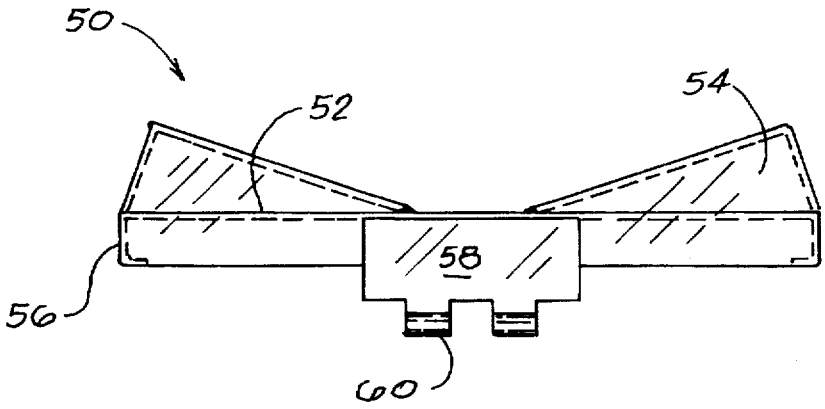
FIG. 2 is a side plan view of the lower portion of the rescue board, taken along lines 2—2 of FIG. 1, according to the present invention.

With respect to FIG. 2, elements 54, 56 and 58 can be seen more clearly. Also, conventional holes 60 in hinge plate 58 can be more clearly seen. Preferably, elements 54 and 58 are attached to plate 52 by any suitable metal attaching techniques, such as, welding.

As discussed earlier, rescue board assembly 2 also includes upper assembly 100. As more clearly seen in FIG. 3, upper assembly 100 includes, in part, plates 102 and 104, U-shaped connections 105, supports 106, step 108, and hinge plate 110. Preferably, elements 102, 104, 105, 106, 108 and 110 are constructed of any suitable metallic material, such as, stainless steel.

Figure 4:
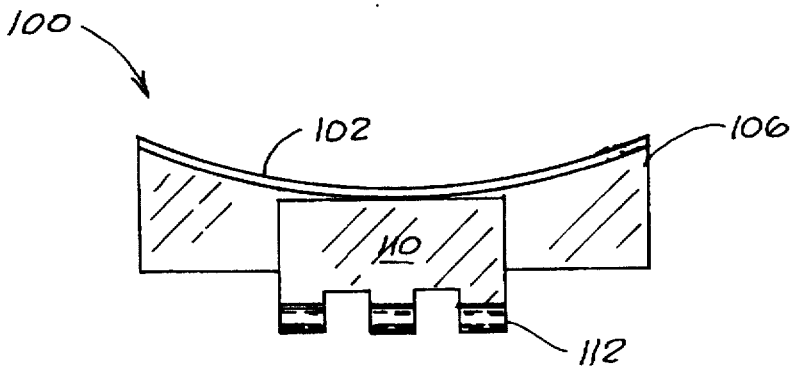
FIG. 4 is a side view of the upper portion of the rescue board, taken along lines 4—4 of FIG. 3, according to the present invention.

With respect to FIG. 4, elements 102, 106 and 110 can be more clearly seen. Also, conventional hinge holes 112 can be seen on hinge plate 110. Also, it is to be understood that elements 102, 104, 105, 108 and 110, can be attached to each other by any suitable conventional metal attaching techniques, such as, welding.

Figure 3:
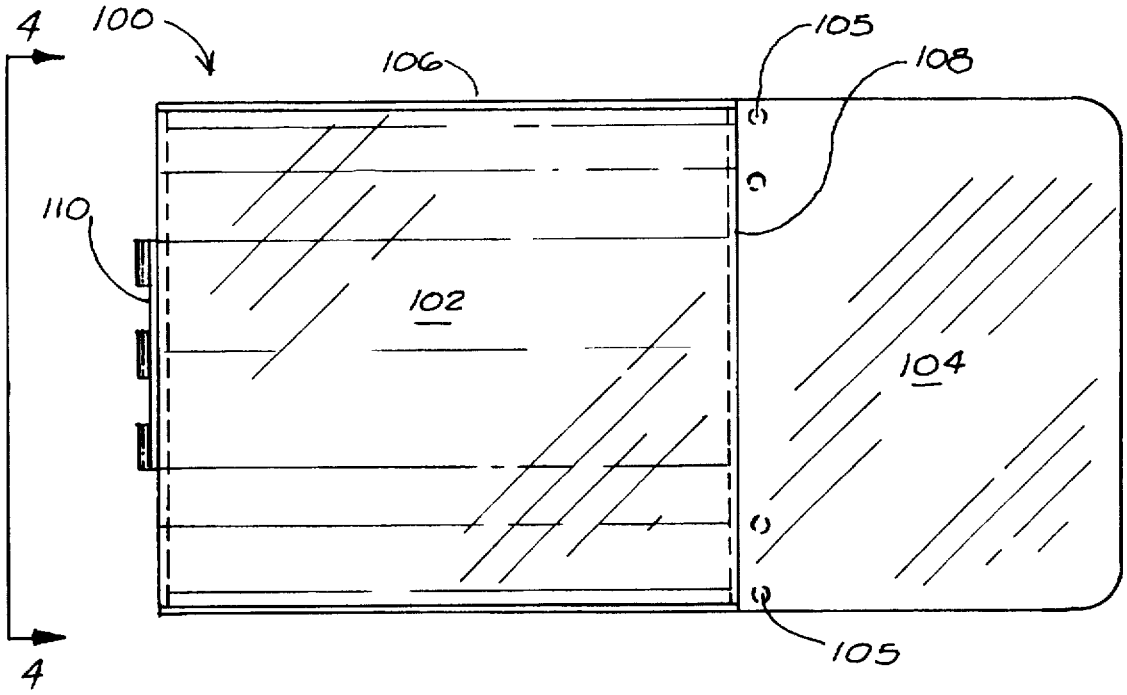
FIG. 3 is a top plan view of an upper portion of the rescue board, according to the present invention.

During the operation of rescue board assembly 2, an injured or unconscious patient 204 is located within a confined space 200. Two individuals (not shown) enter into confined space 200 through small opening 202 and place rescue board assembly 2 within confined space 200 such that lower assembly 50 is located within confined space 200 and upper assembly 100 is located adjacent to small opening 202. Lower assembly 50 is located at approximately a 20 degree angle from the bottom of confined space 200. It is to be understood that if the lower assembly cannot touch the bottom of confined space 200, suitable stops (not shown) can be added to assembly 2 by conventional techniques to still achieve the desired angle. Lower assembly 50 is secured to the outside by upper assembly 100 and U-shaped connections 105. In particular, a rope or other such suitable device is attached to U-shaped connections 105 and another stable connection (not shown) such that rescue board assembly 2 will not substantially move. It is to be understood that hinge 150 includes hinge plate 58 (FIGS. 1 and 2) and hinge plate 110 (FIGS. 3 and 4).

Conventional restraining devices (not shown) are placed upon the wrists of patient 204 and fed through opening 202 to the outside of confined space 200. Individuals (not shown) outside of confined space 200 pull on the restraining devices (not shown) and patient 204 is guided onto lower assembly 50 until the head of patient 204 is located near supports 54 and the hands of patient 204 are located outside of small opening 202.

As shown in FIG. 6, once the head of patient 204 is located adjacent to supports 54 and the arms of patient 204 are located outside of small opening 202, lower assembly 50 is raised level with small opening 202 by rescue team members (not shown) inside of confined space 200. In this raised position, one individual is able to hold assembly 50 level and another individual is able to pull patient 204 along lower assembly 50 and upper assembly 100 through small opening 202 onto a conventional backboard 250 for subsequent transport to a medical facility.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A rescue board for extricating an unconscious or injured patient from a confined space through a small opening, wherein said board is comprised of:

a rigid lower assembly means for assisting in lifting and retaining said patient, wherein said lower assembly means is further comprised of:

a first plate having a first and second end and a length;

a patient support means rigidly attached to said first end of said first plate;

a first plate support means rigidly attached along said length of said first plate; and a first hinge rigidly attached to said first end of said first plate and substantially adjacent to said patient support means; and a rigid upper assembly holding means hingedly attached to said lower assembly means and capable of being secured to an area substantially adjacent to said small opening, wherein said upper assembly is further comprised of: a second plate having a first and second end and a length; a third plate rigidly attached to said first end of said second plate wherein said third plate is used to support a conventional backboard; a second plate support means rigidly attached along said length of said second plate; and a second hinge rigidly attached to said second end of said second plate, wherein said second hinge is shaped so as to cooperatively engage with said first hinge and is engaged therewith.

2. The rescue board, as in claim 1, wherein said first plate, said patient support means, said first plate support means, and said first hinge means are further comprised of:

a metallic material.

3. The rescue board, as in claim 2, wherein said metallic material is further comprised of:

aluminum.

4. The rescue board, as in claim 1, wherein said rescue board is further comprised of:

a rescue board securing means rigidly attached to said third plate.

5. The rescue board, as in claim 4, wherein said securing means is further comprised of:

at least one U-shaped connection.

6. The rescue board, as in claim 4, wherein said second plate, said third plate, said second plate support means, and said second hinge means are further comprised of:

a metallic material.

7. The rescue board, as in claim 6, wherein said metallic material is further comprised of:

stainless steel.

* * * * *